US006921146B2

(12) United States Patent
Wouters

(10) Patent No.: US 6,921,146 B2
(45) Date of Patent: Jul. 26, 2005

(54) METHOD AND APPARATUS FOR REMOVING EXCESS INK FROM INKJET NOZZLE PLATES

(75) Inventor: Paul Wouters, Bonheiden (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 10/438,611

(22) Filed: May 15, 2003

(65) Prior Publication Data

US 2003/0218654 A1 Nov. 27, 2003

Related U.S. Application Data

(60) Provisional application No. 60/385,390, filed on Jun. 3, 2002.

(30) Foreign Application Priority Data

May 24, 2002 (EP) ..... 02100558

(51) Int. Cl.[7] ..... B41J 2/165
(52) U.S. Cl. ..... 347/33; 347/32
(58) Field of Search ..... 347/22, 32, 33

(56) References Cited

U.S. PATENT DOCUMENTS 5,548,310 A * 8/1996 Binnert et al. ..... 347/33
5,606,354 A * 2/1997 Bekki et al. ..... 347/33
5,724,078 A 3/1998 Kotaki ..... 347/33
6,193,353 B1 2/2001 Vives et al. ..... 347/29
6,343,850 B1 2/2002 Domagall ..... 347/33
6,350,012 B1 2/2002 Sarkissian et al. ..... 347/46

FOREIGN PATENT DOCUMENTS

| | | |
|---|---|---|
| EP | 0 621 136 A2 | 10/1994 |
| EP | 1 018 430 A1 | 7/2000 |
| EP | 02 10 0558 | 8/2002 |
| JP | 62-101447 | 5/1987 |
| JP | 6-234221 | 8/1994 |

* cited by examiner

*Primary Examiner*—Shih-Wen Hsieh
(74) *Attorney, Agent, or Firm*—John A. Merecki; Robert A. Sabourin

(57) ABSTRACT

After purging an inkjet print head, large drops are formed on the nozzle plate of the inkjet printer. In order to provide sufficient wiping before printing, drops are first removed by skimming the print head. A skimmer, such as a wiper of A wiping system, just touches the drops that are drained from the print head.

11 Claims, 2 Drawing Sheets

METHOD AND APPARATUS FOR REMOVING EXCESS INK FROM INKJET NOZZLE PLATES

This application claims the benefit of U.S. Provisional Application No. 60/385,390 filed Jun. 3, 2002.

FIELD OF THE INVENTION

The present invention relates to inkjet printing mechanisms, such as printers or plotters.

More particularly the present invention relates to a mechanism for cleaning a print head after it has been purged in order to clear obstructed nozzles.

BACKGROUND OF THE INVENTION

Nowadays inkjet printing systems are used in a wide array of apparatuses in a wide array of applications such as fax, colour photo printing, industrial applications etc. In these printing systems inks, possibly of various colours, are ejected out of at least one array of nozzles located in a print head onto a receiving material.

A long known problem in inkjet printers is that the nozzles through which the ink is projected to the receiving material are blocked by clogging of ink inside the nozzles and on the print head. This renders certain nozzles inoperable and results in a defective print or deteriorated print quality.

To improve the clarity and contrast of the printed image, recent research has been focused to improvement of the used inks. To provide quicker, more waterfast printing with darker blacks and more vivid colours, pigment based inks have been developed. These pigment-based inks have a higher solid content than the earlier dye-based inks. Both types of ink dry quickly, which allows inkjet printing mechanisms to form high quality images.

In some industrial applications, such as making of printing plates using ink-jet processes, certain inks having special characteristics, for example, UV curable inks exist to allow rapid hardening of inks after printing.

The combination of small nozzles and quick drying ink leaves the print heads susceptible to clogging, not only from dried ink and minute dust particles or paper fibres, but also from the solids resident within the ink.

It is known to counteract or correct the problem of clogging by protecting and cleaning the print head by various methods.

- Wiping: Before and during printing, the inkjet print head is wiped clean by using an elastomeric wiper, removing ink residue, paper dust and other impurities.
- Capping: during non-operational periods the print head can be sealed off from contaminants by a sealing enclosure. This also prevents the drying of the ink. The capping unit usually includes a rubber seal placed around the nozzle array.
- Spitting: by periodically firing a number of drops of ink through, each nozzle into a waste ink receiver, commonly called a spittoon, clogs are cleared from the nozzles. This can be concentrated to nozzles which are not used for a certain time but usually all the nozzles are actuated during spitting.
- Vacuum assisted purging: During a special operation, in order to clear partially or fully blocked nozzles, a printing is actuated while on the outside of the nozzles a vacuum is applied. This helps clearing and cleansing the nozzles. The purging is normally performed when the print head is in the capping unit because this unit can provide a good seal around the nozzle array for building the vacuum.

Also other methods exist for cleaning an inkjet print head which may include applying solvents.

These features designed to clean and to protect a print head, are commonly concentrated in a service station which is mounted within the plotter chassis, whereby the print head can be moved over the station for maintenance. An example of such a service station with combined wiping, capping, spitting and purging functions can be found in U.S. Pat No. 6,193,353 herein incorporated by reference in its entirety for background information.

It is inherent to the purging action that a relatively large amount of ink is used. The firing of the nozzles is usually done by actuating all the nozzles at the same time but a sequential actuation of the print elements can also be used.

The ink can be drained from the capping enclosure by the same vacuum source which provides the vacuum for purging. Also alternative systems for removing the ink from the capping enclosure can be provided.

After purging, an excess amount of ink remains on the exterior side of the print head, especially on the nozzle plate. In order to use the print head for recording, a wiping action is performed before printing is started. A wiper passes along the printing surface of the print head.

However several problems have been encountered during wiping after purging and during wiping in general.

- Because of the large amount of ink remaining on the outside of the print head, the wiper does not have enough capacity to clean the print head in a satisfying manner. The large drops or blobs of ink can not be removed sufficiently.
- A state of the art wiper consists of at least one elongated strip of elastomeric material having the length of the nozzle array, parallel with the array and is moved over the print head in a direction perpendicular to the direction of the nozzle array. Upon contact of the strip with the print head a considerable force is exerted upon the print head. As the elastomeric material will have a certain rigidity, a mechanical shock will be given to the print head as the whole length of the wiper simultaneously makes contact with the print head. This shock can disturb the normal equilibrium of the menisci in the nozzles of the print head. Mechanical shocks can even cause intrusion of air into the print head. Also the mounting means of the print head and the wiper can be affected by the shock.
- During the wiping action the whole length of the wiper is slightly deformed as it is held in contact with the print head. The total force acting upon the print head and wiper system as they are kept in pressure contact with each other during the wiping action puts a lot of strain on the mounting assembly and moving mechanism of the print head and wiper system.
- At the end of the wiping action the elastomeric strip reaches the end of the print head and suddenly recoils to its original position. This also generates a mechanical shock while at the same time the ink residues on the tip of the wiper, which are especially large during the first wiping step after purging, are flung away contaminating the inside of the printer.

The result is that after purging normal wiping is insufficient while the wiping action using state of the art wipers gives rise to considerable mechanical stress leading to alignment errors and contamination of the printer.

After wiping, a large amount of ink can remain on the side of the print head forming a meniscus.

It is clear that several drawbacks have to be overcome.

SUMMARY OF THE INVENTION

The above-mentioned advantageous effects are realised for cleaning an inkjet print head having at least one nozzle array by a method of wiping the print head with a wiper, and preceding the wiping action by skimming a skimmer slightly below the print head.

Further advantages and embodiments of the present invention will become apparent from the following description and drawings.

DETAILED DESCRIPTION OF THE PREFERRED EMBODIMENTS

The above-identified drawbacks are avoided by an improved method for cleaning the print head after purging.

The drawbacks are avoided by removing excess ink on the print head before wiping is performed. A method is used to remove the excess ink by use of a skimmer draining the ink drops from the nozzle plate.

While the present invention will hereinafter be described in connection with preferred embodiments thereof, it will be understood that it is not intended to limit the invention to those embodiments.

Figure 1A:
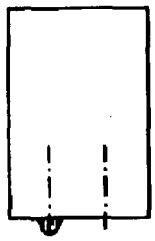
FIGS. 1A and 1B, respectively, show a transversal and lateral view of a print head with accumulated ink drops.
Figure 1B:
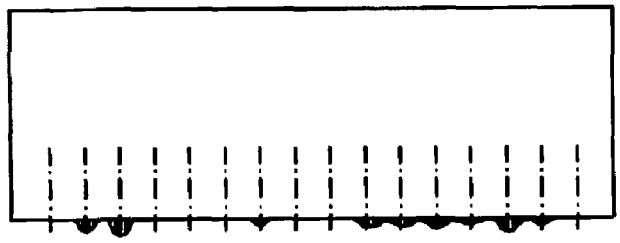

After purging ink, large drops and blobs of ink accumulate on the print head as shown in FIGS. 1A and 1B. These are removed by a skimmer slowly skimming the print head thereby making contact with drops of ink on the surface of the print head, but without making contact with the surface of the print head itself.

Figure 2:
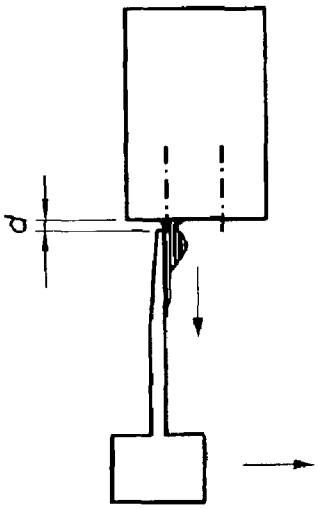
FIG. 2 illustrates the skimming action.
Figure 3:
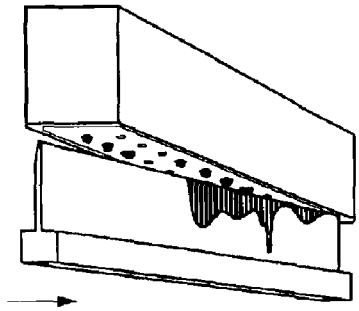
FIG. 3 shows the drainage of the excess of ink along the skimmer.

The skimming action is illustrated in FIG. 2. The distance d between the print head and the skimmer needs to be smaller than the size of the drops hanging from the surface of the print head. As illustrated in FIG. 3, when the skimmer makes contact with a drop on the surface it will, due to surface tension characteristics and the effect of gravity, be drained downwards along the skimmer.

This provides a pre-cleaning step after purging, avoiding problems caused by the excess of ink during the wiping action following the skimming step.

The distance d between the bottom side of the print head and the skimmer is in the range of 0–5 mm. Skimming alternatively can be performed by just touching the print head without exerting force to the print head. Preferably a clearance is kept between the print head and the skimmer. Preferably the minimum distance at which the skimmer passes the print head is between 0.5 and 5 mm.

The direction in which the skimmer passes along the print head is not important but preferably a mechanism is provided which is coupled to the mechanism for moving the wiper. Then a skimmer having the size of the print head is used. FIG. 2 shows the situation wherein the skimming direction is perpendicular to the longitudinal direction of the nozzle array.

In FIG. 3. the skimmer has an angled position to the longitudinal direction of the nozzle array. Direction of movement is not critical.

Possibly the skimming movement is along the direction of the nozzle array. A small skimmer can then be used having a size of the broadness of the nozzle array.

Preferably the wiper itself serves as skimmer. This is most cost effective as no separate system has to be provided for skimming. By lowering the wiper so that is just clears the print head during wiping causes it to skim the surface of the print head to serve as skimmer for removing excess of ink. During skimming the speed of translation of the wiper is reduced as to provide enough time to allow the drop to drain slowly to the bottom as can be seen in FIG. 3. No separate translation mechanism is needed, only the speed is to be adapted. Skimming speeds are preferably between 0.001 and 0.5 m/s An advantageous effect is that, due to the liquid ink having a higher solvent content than dried ink, the wiper is partially cleaned by ink running along the surface of the wiper.

Distance d of the skimmer or wiper from the print head and speed during sweeping can be chosen arbitrarily. Depending upon characteristics of the ink in use and its surface tension, the property of the outer surface of the inkjet print head, constitution, size of the wiper, etc., the skimming distance d and speed can be chosen to obtain optimal result, if possible in combination with the subsequent wiping action.

Possible skimming can be performed using a wick for draining ink from the print head.

Also a foil can be used for skimming the print head.

Normally the skimmer is an elastomeric element having a hardness of 30 to 80 Shore A.

Figure 4:
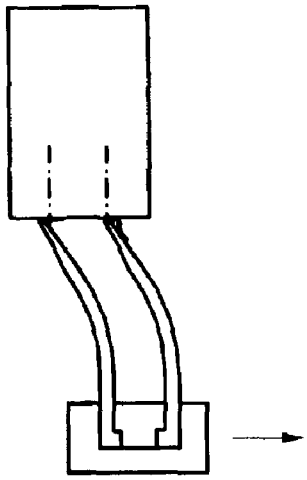
FIG. 4 shows a dual wiping system in contact with the print head.

The skimming action is followed by a normal wiping action. This can be done using a single or a double wiper as shown in FIG. 4. During wiping the wiper is pressed against the print head.

Figure 5:
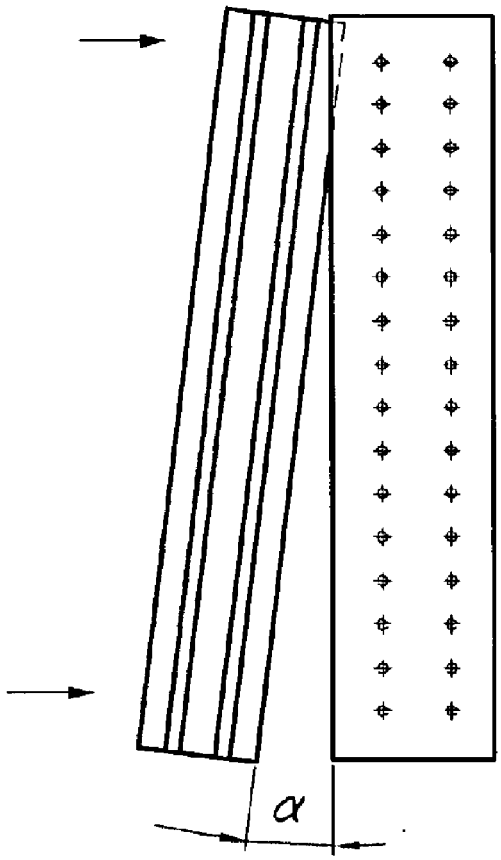
FIG. 5 illustrates the angled positioning of the wiper system to the nozzle array.

In order to avoid mechanical shocks, stress and undesirable flinging of ink from the wiper during recoil, the wiper is placed, as illustrated in FIG. 5 for a dual wiper system, at a small angle $\alpha$ regarding the direction perpendicular to the translation direction. The angle $\alpha$ can be any angle between 1 and 99 degrees but the range is practically between 1 and 10 degrees. Preferably the angle $\alpha$ is in the range between 1 and 3 degrees.

As seen in FIG. 5, the wiping direction is usually perpendicular to the direction of the nozzle array so that the wiper blades are positioned at a small angle $\alpha$ in relation to the nozzle array.

During wiping the wiper makes a first contact with the print head at the first end. Because only a small part of the wiper encounters the print head no great mechanical forces are involved.

During further movement of the wiper the contact point gradually moves from the first end to the trailing end. Parts of the wiper clearing the print head will not recoil but fold back slowly as the neighbouring part of the wiper is still in contact with the print head during the wiping action.

Figure 6:
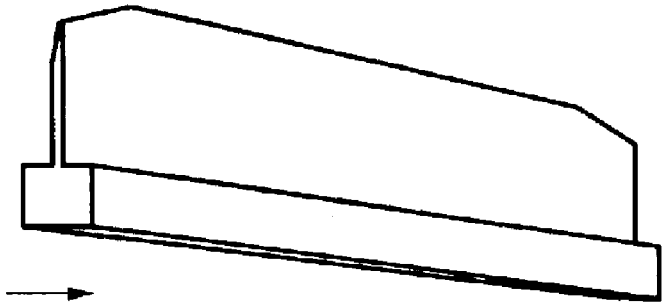
FIG. 6 shows a wiper having bevelled edges.

When the trailing end of the wiper clears the print head, this end will show a certain amount of recoil, but due to the restricted length of wiper blade involved the forces are small and no ink will be flung from the wiper resulting in less contamination of the printing mechanism. This can even be improved by bevelling the extremities of the wiper blades as indicated in FIG. 6. The bevelled edges are preferably located outside the area of the nozzle array on the print head.

It is clear that less mechanical stress and shocks cause less wear and tear in the printer.

The wiper preferably has at least the length of the nozzle array. Wiping direction may vary. Usually wiping will be done in a direction perpendicular to the nozzle array, but other directions can be possible. Wiping can be done perpendicular to the direction of the slanted direction of the wiper itself. Alternatively a smaller wiper can be used wiping in the direction of the nozzle array itself.

Preferably the wiper has a hardness between 30 and 80 ShoreA.

PRACTICAL EXAMPLE

An inkjet printer having a shuttling print head having a length of 72 mm is used for printing images using an oil based ink.

The inkjet print head has a dual array of nozzles having a length of 54 mm.

The print head is capped by the capping unit having a seal around the nozzle array.

This is done by placing the print head over the capping unit and raising the maintenance station so the capping unit now holds the print head. A vacuum is applied inside the capping unit and at the same time the nozzles are driven in order to clear clogged nozzles. Released ink is drained from the capping unit.

After purging the print head, the maintenance unit is lowered so the print head clears the capping unit. As a result of purging, large drops of ink are formed hanging down from the print head. Depending of the volume of the drops, they typically can have dimensions of 1 to 5 mm in height.

The print head is now brought near the wiper system mounted on the maintenance station. The wiper has at least a length of the print head which is about 54 mm. The maintenance station is raised so that the edge of the wiper is brought to a height corresponding to 0.5 mm clearance with the bottom edge of the print head.

The wiper is used as skimmer by translating it underneath the print head at a speed of 0.02 m/s. Drops hanging from the print head are thus captured and flow downwards along the wiper.

After the skimming action the wiper is repositioned and is further raised and a wiping action is started.

The wiper has a hardness of 70 ShoreA and the direction of the wiper makes an angle of 2 degrees relatively to the direction of the nozzle array. Wiping is performed at a speed between 0.1 to 0.5 m/sec. Preferably the speed is about 0.2 m/sec. Wiping speed can be adjusted according to ink and wiper characteristics, e.g. surface tension, density of the ink, hardness or length of the wiper etc. An empirical approach can be used for determining the optical speed, constitution, pressure force and contact angle of the wiper.

The skimming step is hereinbefore described as a treatment of the print head after purging. It can be understood that the skimming step can be performed at any moment if necessary during the printing process.

The wiping action can also be performed at any moment if the need exists. Also a periodical wiping can be provided. It is clear that the slanted position of the wiper relative to the nozzle array is also advantageous during each wiping action.

Having described in detail preferred embodiments of the current invention, it will now be apparent to those skilled in the art that numerous modifications can be made therein without departing from the scope of the invention as defined in the appending claims.

What is claimed is:

1. A method for cleaning an inkjet print head having a nozzle array, the method comprising the step of:

first, wiping through an ink drop with a first wiping blade without the first wiping blade contacting the nozzle array; and second, wiping said print head by contacting and traversing a separate second wiping blade along the nozzle array.

2. The method according to claim 1 wherein said first wiping blade is a wick.

3. The method according to claim 1 wherein said first wiping blade is a foil.

4. The method according to claim 1 wherein a direction in which said first wiping blade passes said print head is perpendicular to a longitudinal direction of the nozzle array.

5. The method according to claim 1 wherein a direction in which said first wiping blade passes along said print head is parallel to a longitudinal direction of the nozzle array.

6. The method according to claim 1 wherein the first wiping blade has a hardness between 30 and 80 shore A.

7. An apparatus for cleaning a print head having a nozzle array, the apparatus comprising a first wiping blade for wiping through an ink drop without contacting the nozzle array and a separate second wiping blade for wiping the print head by contacting and traversing the second wiping blade along the nozzle array.

8. The apparatus of claim 7 wherein the first wiping blade is a wick.

9. The apparatus of claim 7 wherein the first wiping blade is a foil.

10. The apparatus of claim 7 wherein a direction in which said first wiping blade passes said print head is perpendicular to a longitudinal direction of the nozzle array.

11. The apparatus of claim 7 wherein a direction in which said first wiping blade passes said print head is parallel to a longitudinal direction of the nozzle array.

* * * * *